US006090221A

United States Patent [19]

Gan et al.

[11] Patent Number: 6,090,221

[45] Date of Patent: Jul. 18, 2000

[54] SYSTEM FOR TREATING EXTERIOR SURFACES OF BUILDINGS

[75] Inventors: Livne Gan, Midreshet Ben-Gurion; Arieh Oohen, Arad; Niv Sofer, Tel Aviv, all of Israel

[73] Assignee: Skybot Ltd., Tel Aviv, Israel

[21] Appl. No.: 09/154,202

[22] Filed: Sep. 16, 1998

[51] Int. Cl.[7] ..... B08B 5/04

[52] U.S. Cl. ..... 134/21; 15/103; 15/302; 134/172; 180/164; 180/901

[58] Field of Search ..... 15/50.1, 98, 103, 15/302; 114/222; 134/21, 172; 180/6.7, 9.1, 164, 901

[56] References Cited

U.S. PATENT DOCUMENTS

| | | | |
|---|---|---|---|
| 3,641,607 | 2/1972 | Lemelson . | |
| 3,958,652 | 5/1976 | Urakami et al. . | |
| 3,991,842 | 11/1976 | Larsen . | |
| 4,025,984 | 5/1977 | Hoener | 15/302 |
| 4,095,378 | 6/1978 | Urakami . | |
| 4,112,535 | 9/1978 | Wild et al. | 134/172 |
| 4,136,419 | 1/1979 | Hetman et al. | 15/302 |
| 4,664,212 | 5/1987 | Nagatsuka et al. . | |
| 4,688,289 | 8/1987 | Urakami | 15/98 |
| 4,797,969 | 1/1989 | Caduff | 15/302 |
| 5,240,503 | 8/1993 | Levy et al. . | |
| 5,366,038 | 11/1994 | Hidetsugu et al. . | |
| 5,465,446 | 11/1995 | Chang . | |
| 5,487,440 | 1/1996 | Seemann . | |
| 5,707,455 | 1/1998 | Tomita . | |
| 5,715,557 | 2/1998 | Hsu . | |
| 5,884,642 | 3/1999 | Broadbent | 134/172 |
| 5,890,250 | 4/1999 | Lange et al. | 15/302 |

*Primary Examiner*—Terrence R. Till
*Attorney, Agent, or Firm*—Mark M. Friedman

[57] ABSTRACT

A system for treating an external surface of a building, has (a) at least one treatment unit configured to treat the external surface of the building with a pressurized fluid; (b) at least one suspension system for suspending the treatment unit adjacent to the external surface; (c) at least one suction unit associated with the treatment unit, being activated by the pressurized fluid to generate suction at a suction port; and (d) at least one suction head in fluid connection with a suction port to clamp against the external surface.

17 Claims, 3 Drawing Sheets

SYSTEM FOR TREATING EXTERIOR SURFACES OF BUILDINGS

FIELD OF THE INVENTION

The present invention is a system which employs steam powered vacuum to clean and maintain buildings.

BACKGROUND OF THE INVENTION

The external surfaces of tall buildings require treatment from time to time for aesthetic and/or functional reasons. For example, it is desirable to clean the outside surfaces of the buildings' windows.

Several techniques are adopted to gain access to a building exterior for the purpose of effecting required treatments of the building. The majority of buildings do not feature external access ways surrounding each floor, which could be used by a worker to execute external cleaning of the building. In these cases, one normally relies on erecting scaffolding. Alternatively, some buildings use a small scaffold platform, which may be supported by a cable and is attached to an appropriate securing device on the roof of the building.

The disadvantages of these practices include the following. Firstly, there is a danger of the worker falling due to adverse weather conditions, or due to human error. Secondly, the worker is exposed to high concentrations of the materials being used to treat or clean the building. Thirdly, this work is labor intensive and repetitive and therefore as the worker tires, the job takes a longer time.

The background art contains several automated devices to try to overcome the aforementioned problems, such as U.S. Pat. No. 5,240,503, and U.S Pat. No. 5,707,455, which disclose systems for treating exterior surfaces of a building. These devices use a separate power supply for the driving source.

The background art includes devices that can be used for automated cleaning of building surfaces and machines that use suction. U.S. Pat. No. 5,487,440, U.S. Pat. No. 5,366,038, U.S. Pat. No. 3,958,652 and U.S. Pat. No. 4,095,378 disclose robots for performing a working operation on a surface, which use a series of vacuum cups to engage the surface to be traversed. However, these devices are all powered by through a specially provided power source.

The known devices for cleaning tall buildings suffer from the following disadvantages. Many of these devices are very heavy due to the presence of weights (used to stabilize the devices) and electrical motors. The devices that do not use suction are affected by the weather conditions. In conditions of strong wind, these devices are unable to stay in one position. None of the existing devices can move at the same time as cleaning. In addition, they cannot access angled surfaces on buildings, such as corners, and consequently cannot clean such surfaces.

There is therefore a need for a system and method, such as is disclosed in the present invention, to provide a solution to the aforementioned problems and to be more efficient and cost-effective than known automated cleaning devices.

SUMMARY OF THE INVENTION

The device of the present invention is a system that is used for steam cleaning, other treatments and maintenance of tall buildings. It can also be used for accessibility to positions in high buildings, such as in the case of a fire. The movement of the system is powered by a pressurized fluid, such as steam, which also powers a vacuum pump used to generate suction retention against the wall of the building. A pressurized fluid can be a liquid or gas or a mixture thereof and may include a suspension of solid particles.

In a first embodiment the present invention provides a system for treating an external surface of a building, the system comprising: (a) at least one treatment unit, the treatment unit being configured to treat the external surface of the building with a pressurized fluid; (b) at least one suspension system for suspending the at least one treatment unit adjacent to the external surface; (c) at least one suction unit associated with the treatment unit, the suction unit being activated by the pressurized fluid to generate suction at a suction port; and (d) at least one suction head in fluid connection with the suction port and deployed to clamp against the external surface.

In a preferred embodiment the at least one suspension system comprises: (a) a first anchor attached to an upper portion of the external surface of the building; (b) a second anchor attached to a lower portion of the external surface of the building; and (c) at least one cable attached at one end to the first anchor and at an opposing end to the second anchor; and (d) at least one cable connector associated with the at least one treatment unit, the at least one cable passing through the cable connector, such that that the treatment unit is suspended by the at least one cable.

In a preferred embodiment the treatment unit is a cleaning unit.

In a preferred embodiment the pressurized fluid includes steam.

In a preferred embodiment the system for treating an external surface of a building further comprises a drive mechanism for moving the treatment unit, the drive mechanism including a belt, wherein the at least one suction head is implemented as a plurality of suction heads deployed in spaced relation along the belt.

In a preferred embodiment the drive mechanism is powered by pressure of the pressurized fluid.

In a preferred embodiment the system further comprises a valve associated with each of the plurality of suction heads and a control system associated with each of the valves, the control system being configured to selectively open a subset of the valves corresponding to those of the suction heads in contact with the exterior surface at any given time.

In a preferred embodiment the suction unit includes a piston system.

In a preferred embodiment the treatment unit further includes a secondary movement mechanism, the secondary movement mechanism being activated by pressure of the pressurized fluid.

In a preferred embodiment the system for treating an external surface of a building further comprises a control unit associated with the drive mechanism and configured to control the movement of the treatment unit.

In a preferred embodiment the control unit is further configured to control the treatment unit.

In a preferred embodiment the belt is configured to conform to the contours of a non-planar surface.

In a second embodiment the present invention provides a system for treating an external surface of a building, the system comprising: (a) at least one treatment unit, the treatment unit being configured to treat the external surface of the building; (b) at least one suspension system for suspending the at least one treatment unit adjacent to the external surface; (c) at least one suction unit associated with the treatment unit, the suction unit being activated to generate suction at a suction port; (d) a plurality of suction heads in fluid connection with the suction port and deployed to clamp against the external surface; and (e) a drive mechanism for moving the treatment unit, the drive mechanism including a belt, wherein a plurality of suction heads are deployed in spaced relation along the belt.

In a preferred embodiment, the system further comprises (a) a fluid connection hub rotatably mounted with respect to a supply of the pressurized fluid; and (b) a plurality of tubes forming fluid connections between the fluid connection hub and each of the suction heads.

In a third embodiment the present invention provides a method of suction clamping a device configured for treating an external surface of a building with a pressurized fluid, the method comprising employing the pressure of the pressurized fluid to operate a suction unit to generate suction.

In a preferred embodiment the method of suction clamping is for suction clamping a cleaning device.

DETAILED DESCRIPTION OF THE PREFERRED EMBODIMENTS

The present invention is a system for treating an external surface of a building, which includes at least one treatment unit, the treatment unit being configured to treat an external surface of a building with pressurized fluid, at least one suspension system for suspending cables and at least one suction unit associated with the treatment unit and activated by the pressure of the pressurized fluid.

This system can be used for steam cleaning and maintenance of tall buildings. The movement of the system is preferably powered by a pressurized fluid, such as steam and a pressurized fluid powered vacuum pump is preferably used to generate suction retention against the wall of the building. The device is light weight, due to not requiring an electrical motor and not containing stabilizing weights, or cleaning implements such as brushes. The system is able to simultaneously clean and move and can conform to all contours of any non-planar surface of a building.

The principles and operation of systems according to the present invention may be better understood with reference to the figures. The figures show one embodiment of the present invention and are not limiting.

Figure 1:
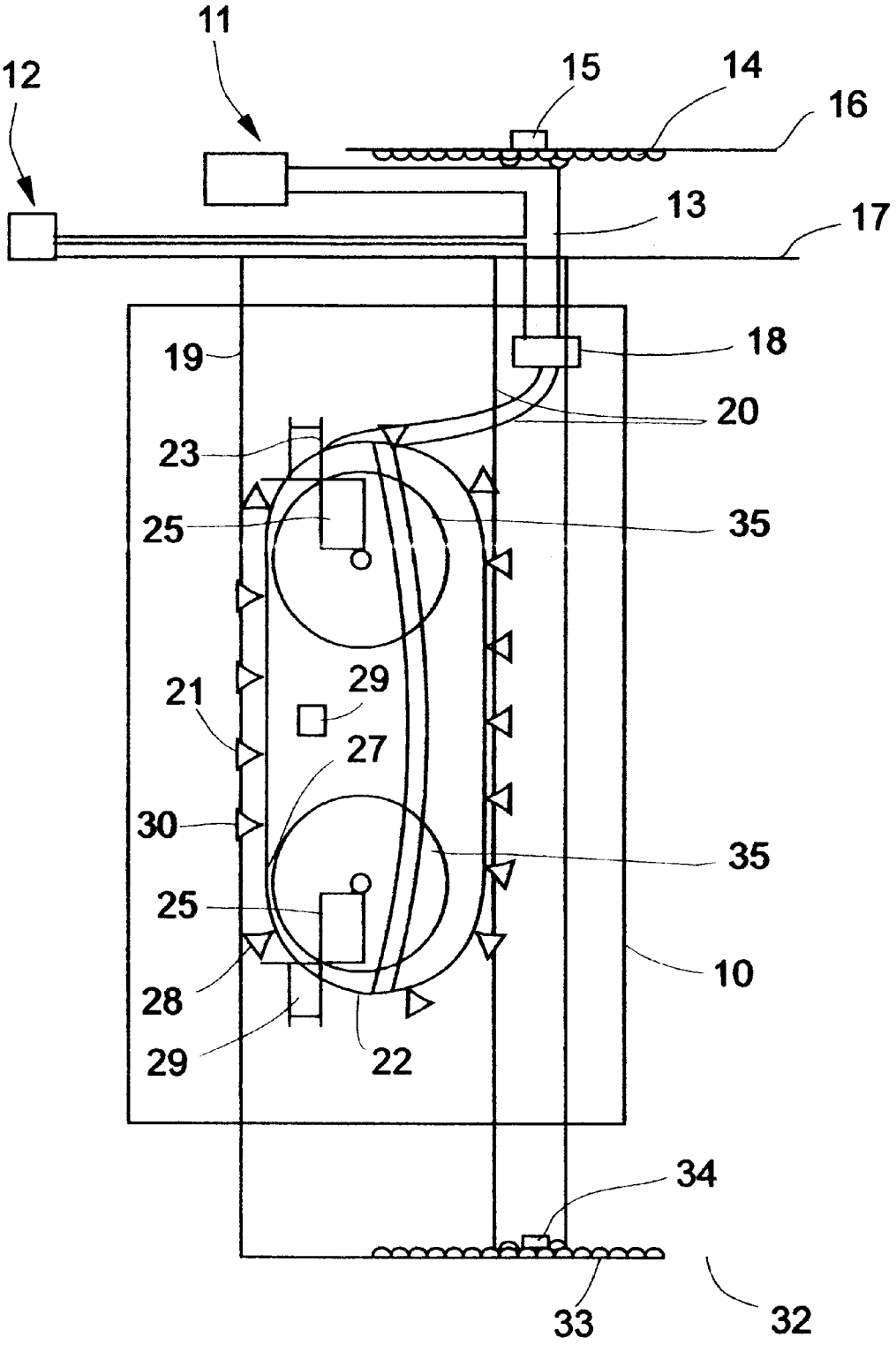
FIG. 1 shows a schematic side view of the system of the present invention.

FIG. 1 shows schematically an overview of the system according to the present invention. This system can be used to clean and treat the exterior surfaces of a building 19 as well as being used for applications necessitating climbing up the face of a building, such as in a fire rescue. The main components of the system include supporting members 16 and 20, control units 18 and 29, treatment units 23 and 24, a vacuum supply system, suction units 30 and a drive mechanism.

Supporting members 20 are preferably cables and can be made up by connecting more conveniently smaller sized units to give the full length supporting members 20. The supporting members 20 are connected to the building above the point being treated, by a securing mechanism attached to supporting member 16, which extends away from and overhangs the building. The supporting member 16 is preferably, secured at one end to the top of the building 17 and at the other end to a surface 32, which can be the ground or any lower point of the building.

The pressure for the cleaning device can be provided by a pressurized fluid producing unit 12. The pressurized fluid can have three functions: (a) to be used to provide pressurized fluid to the treatment units 23 and 24; (b)to produce suction of the suction units 30 and; (c) to power the drive mechanism. Optionally, one or more of these functions can be provided by pressure produced by unit 11. Unit 11 can provide pressure preferably by using a piston or an oil pump. These devices can work optionally by using air pressure or hydraulic pressure. Unit 11 can be but is not limited to being connected to a fluid producing unit 12. This is dependent on the type of situation that is being treated with the device of the present invention. In the case of a very tall skyscraper it is not viable to have unit 11 attached to unit 12. Pressure tubing 13 is attached to unit 12 and unit 11. Units 11 and 12 can alternatively be attached to an electrical motor or can use pressure to move the cleaning device 10. Units 11 and 12 are located at one end of the system.

Pressure tubing 13 connects units 11 and 12 to the treatment units 23 and 24. The example shown of the system of the present invention provides two treatment units 23 and 24, which are preferably cleaning units, or units that provide other treatments, such as waterproofing exterior surfaces of buildings. For the purpose of description of one embodiment of the present invention in FIG. 1, treatment units 23 and 24 will be referred to as cleaning units. One of the cleaning units 23 and 24 preferentially cleans when the device is descending the building, while the second cleaning unit cleans on ascending the building. Alternatively both cleaning units can clean at the same time. The two cleaning units 23 and 24 as shown are separated by the main body of the cleaning device 10, which contains the other components of the cleaning device.

Tubing 13 also connects the pressurized fluid to the attachment system comprising a belt 22 with attached suction units 30. The belt can be made of flexible material or made of rigid links connected to provide the required flexibility. The belt 22 uses a drive wheel 35 to rotate. The drive wheels are connected to a hydraulic motor 25. FIG. 1 is only a schematic representation of the system of the present invention. The hydraulic motor 25 may be directly associated with the drive wheels 35 and can be used to drive both or either of the drive wheels 35. Suction units 30 are used to attach the device 10 to the exterior surface of the building 19. There are a plurality of suction heads 28 in fluid connection with a suction port 27 and they are deployed to clamp against the external surface 19. A valve 21 is associated with each suction head 28. A control system is configured to selectively open a subset of the valves 21. A drive mechanism for moving the treatment units 23 and 24, uses the aforementioned belt 22, with a plurality of suction heads 28 deployed in spaced relation along the belt 22. The suction units 28 can be used optionally only for attachment to the building with a motor being used for moving the device up and down the building. Alternatively, the suction units 28 can be used for both moving the device up and down the building and also for attachment to the building.

Optionally, protective foam cushions (not shown) on either side of the main body of the cleaning device 10 may be added. The cushions are preferably made from materials such as polyethylene foam. They prevent damage to the external surface 19 such as windows and to the main body of the cleaning device 10.

A control unit 29 is preferably used to provide quality control of the cleaning. In addition control units 18 control flow of the pressurized fluid and consequently the activation of the system. The control systems are shown schematically in FIG. 1. The control system can employ any conventional technique, such as using I.R., U.V. and video. The control units 18 and 29 are electrically connected to each other and to the units whose function they are controlling. The system can be automatically or remotely controlled. Using any of these techniques, the treatment system can monitor the condition of the exterior of the building 19 and deduce whether more treatment is needed.

The cleaning device 10 can move up the exterior surface, or down as the need arises. The movement of the device 10 up and down the building can be achieved by conventional techniques such as using a winch. In a preferred implementation, the drive mechanism and suction of the cleaning device is used to raise and lower the device 10.

The supporting members 20, which are preferably cables secure a track 14 at the top of the system 17 and another track 33 at the bottom of the system 32. Both tracks 14 and 33 can in a preferred embodiment contain a motor 15 or 34, which can optionally move the device sideways. A control unit can monitor by the distance between the two motors 15 and 34, how the device 10 has proceeded and where it is located.

It is advantageous to look at each component of the present invention in greater detail in order to understand the structure and function of the present invention.

Figure 2:
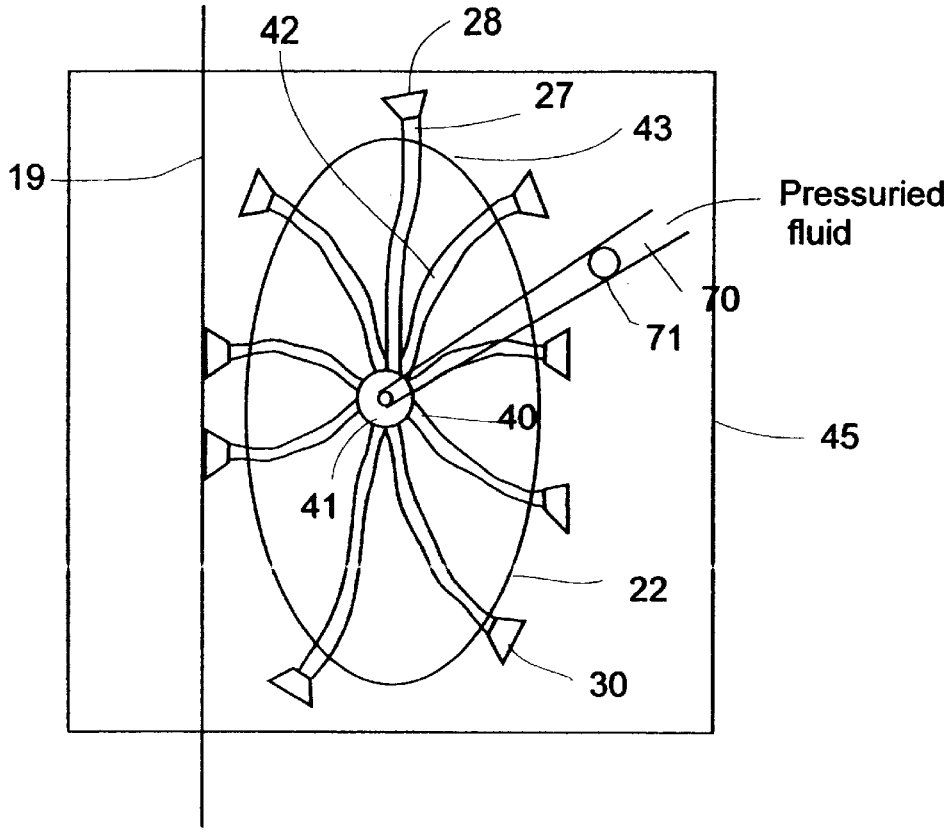
FIG. 2 shows a schematic structure of the rotary fluid attachment device and drive mechanism.

The pressurized fluid drive mechanism is shown schematically in FIG. 2. Pressurized fluid enters the system through pressure tubing 70 and reaches the hub 41. The pressure is controlled by a valve 71, preferably a three way valve. Valve 71 can optionally be located on the roof of the building. The hub 41 has a plurality of outlets 40, which are connected by pressure tubing to the suction units 30 on the belt 22. In this way the suction units 30 on the belt 22 rotate at the same rate as the rotating hub 41. An alternative to pressure distributed through the hub is provided.

In one embodiment of the device of the present invention, vacuum is provided to the suction units via the vacuum pump (not shown) and vacuum tubing (not shown). In an alternative embodiment the suction units are activated by a piston attached to each suction unit, as described in FIG. 4.

The following shown schematically in FIG. 2 is a more detailed description of the case where vacuum is provided to the suction units via the vacuum pump and vacuum tubing 42. The pressurized fluid producing unit (not shown) produces pressurized fluid, such as steam, which can pass through pressure tubing 70 to a pressure valve 71. An additional valve (not shown) controls the production of the pressurized fluid and can be used to shut off the pressurized fluid. The valves are typically electrically connected to the control units and in this way there is communication between the valves and controls. The valve 71 contains a plurality of outlets, which can be optionally open or shut. The control decides which to open and which to close. The pressurized fluid can then travel through pressure tubing 42 to the suction units 30.

In addition FIG. 2 shows schematically the rotary fluid attachment device 45. The rotatable fluid connection hub 41 contains numerous outlets 40. Optionally, when pressure driven, each outlet 40 is connected by pressure tubing 42 to a corresponding piston unit 43 on a suction unit 30 (as described in FIG. 4) to produce a rotary fluid connection system.

Alternatively, when vacuum driven, each outlet 40 is connected directly by vacuum tubing 42 to a corresponding suction unit 30 on the belt structure 22 as previously described. Therefore, the rate of movement of the suction unit belt 22 is by necessity the same as the rate of the movement of the hub 41.

Figure 3:
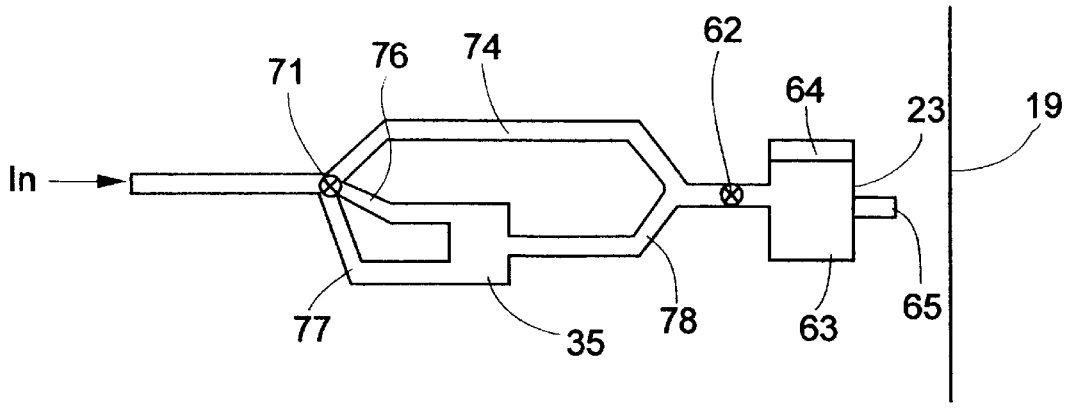
FIG. 3 shows a schematic structure of the flow of pressurized fluid to the treatment unit.

FIG. 3 schematically shows that the valve 71 controls the flow of the pressurized fluid to the treatment systems. Valve 71 can optionally be located on the roof of the building. When the system of the present invention is stationary, the valve 71 opens through tube 74 to provide pressure and pressurized fluid to the cleaning units 23 and 24. When the cleaning unit is moving, the valve passes the pressurized fluid through tube 76 or tube 77, which drive the drive wheel 35. Tube 76 is used preferably when the device of the present invention is ascending the building and the pressurized fluid drives the drive wheel 35 in one direction. Tube 77 is preferably used when the device of the present invention is descending the building and drives the drive wheel 35 in the opposite direction. The pressure and pressurized fluid for treatment is then provided to the cleaning apparatus via tube 78.

The treatment unit 23 or 24 is schematically shown in FIG. 3. For description purposes, one particular cleaning unit will be described. The pressurized fluid is provided through tube 78, (in the case of the device moving), or tube 74 (in the case of the device being stationary). The treatment units 23 or 24 can move sideways, left and right, or inwards and outwards using state of the art techniques, such as a screw system, whereby applied pressure moves the screw, which in turn moves the system along the screw. Alternatively a secondary movement mechanism activated by the pressure of the system can be used to move the treatment units 23 and 24 independently of the movement of the cleaning device 10.

The treatment unit can contain as is shown in FIG. 3 a spray and cleaning unit 63, which sprays through its nozzle 65 the materials needed for treatment of the building, such as the pressurized fluid or other cleaning materials. A blower unit 64 can be optionally connected to the spray and cleaning unit 63 and removes the dirt and water residues and any other residue. A valve 66 connected to the spray and cleaning unit 63 is open only at the time of cleaning. When the valve 62 is open the pressurized fluid and other treatment material flow into the spray and cleaning unit 63, which expels the pressurized fluid and other treatment material through a nozzle 65 onto the surface of the building 19. The cleaning device can move and clean simultaneously.

The system of the present invention provides' two cleaning units 23 and 24. One of the cleaning units 23 and 24 preferentially cleans when the device is descending the building, while the second cleaning unit cleans on ascending the building. Alternatively both cleaning units can clean at the same time.

Figure 4:
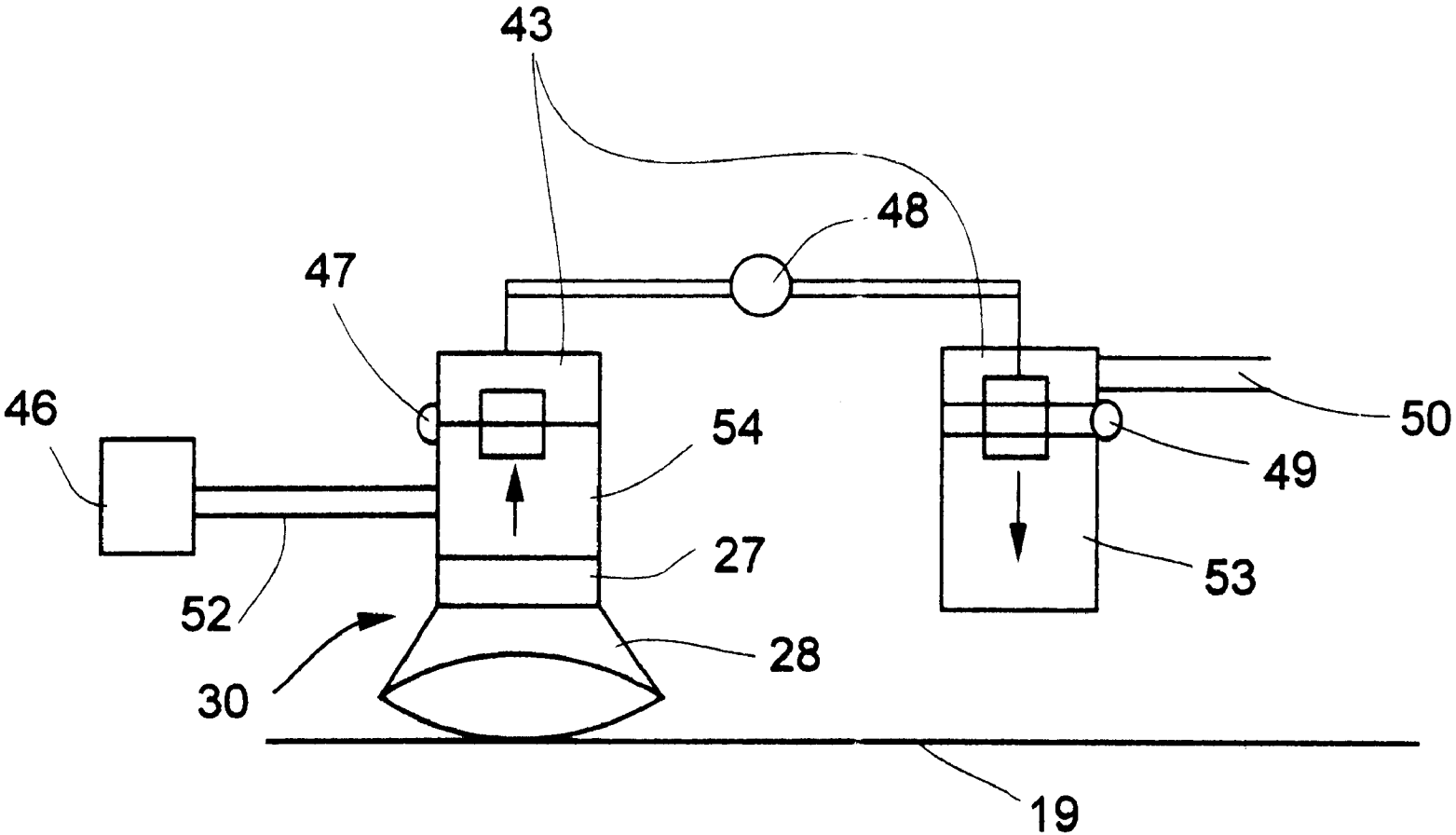
FIG. 4 shows a schematic structure of suction activation of the suction units.

FIG. 4 shows schematically the attachment system. The cleaning system 10 uses a multiplicity of suction units 30 to attach the cleaning system 10 to the exterior surface of the building 19. The suction unit 30 consists preferably of a suction head 28 that has access to the exterior surface of the building and a suction port 27 that is connected to a suction activation mechanism.

The suction can use either a vacuum pump 46, such as an oil pump, or a piston unit 43, or any other type of suction activating unit. FIG. 2 shows the belt 22, to which the suction units 30 are attached. It should be noted that the belt 22 can conform to any contour of an exterior surface 19 and therefore all surfaces can be treated. Existing devices are unable to do this. A rotatable fluid connection hub 41 is positioned at the center of the belt 22.

Vacuum can be supplied to the suction units 30 in a number of ways. In one example of the present invention (FIG. 4), a vacuum pump 46 passes vacuum via vacuum tubing 52 directly to the suction heads 28. In an alternative embodiment, pressure is provided through pressure tubing 50 which enters a first piston 53 of the piston unit 43, and which is connected with a pivot 48 to a second piston 54. When the pressure enters the system the first piston 53 will move downwards inducing the second piston 54 to move upwards and producing a vacuum between the suction heads 28 and surface 19. The suction units 30 can work using both these embodiments simultaneously or either embodiment by itself. In an alternative embodiment, the suction units can use pressurized fluid powered vacuum together with an electric piston to produce greater suction.

The suction heads 28 can be made from a range of materials, preferably from flexible silicone. Valves 49 and 47 are connected electrically to a control unit (not shown), which can control the vacuum supply to the suction units 30.

Advantages of various embodiments of the present invention include, use at night and not being affected by adverse weather conditions. The device can move at the same time it cleans and it is relatively light. In addition, due to the flexibility of the belt containing the suction units, the device of the present invention can access contours of any non-planar surface of a building.

What is claimed is:

1. A system for treating an external surface of a building, the system comprising:

(a) a device housing:

(i) at least one treatment unit, said treatment unit being configured to treat the external surface of the building with a pressurized fluid;

(ii) at least one suction unit associated with said treatment unit, said suction unit being activated by said pressurized fluid to generate suction at a suction port;

(iii) at least one suction head in fluid connection with said suction port and deployed to clamp against the external surface; and (iv) a drive mechanism mechanically linked to said at least one suction head and configured to move said at least one suction head relative to said device in a manner such as to generate motion of said device substantially parallel to the external surface; and (b) at least one suspension system configured for suspending said device adjacent to the external surface.

2. The system of claim 1, wherein said at least one suspension system comprises:

(a) a first anchor attached to an upper portion of the external surface of the building;

(b) a second anchor attached to a lower portion of the external surface of the building; and (c) at least one cable attached at one end to said first anchor and at an opposing end to said second anchor, said device being suspended from said at least one cable.

3. The system of claim 1, wherein said treatment unit is a cleaning unit.

4. The system of claim 1, wherein said pressurized fluid includes steam.

5. The system of claim 1, wherein said drive mechanism includes a belt, said at least one suction head being implemented as a plurality of suction heads deployed in spaced relation along said belt.

6. The system of claim 5, further comprising a valve associated with each of said plurality of suction heads and a control system associated with each of said valves, said control system being configured to selectively open a subset of said valves corresponding to those of said suction heads in contact with the exterior surface at any given time.

7. The system of claim 5, wherein said belt is configured to conform to the contours a non-planar surface.

8. The system of claim 1, wherein said drive mechanism is powered by pressure of said pressurized fluid.

9. The system of claim 1, wherein said suction unit includes a piston system.

10. The system of claim 1, wherein said treatment unit further includes a secondary movement mechanism, said secondary movement mechanism being activated by pressure of said pressurized fluid.

11. The system of claim 1, further comprising a control unit associated with said drive mechanism and configured to control the movement of said treatment unit.

12. The system of claim 10, wherein said control unit is further configured to control said treatment unit.

13. A system for treating an external surface of a building, the system comprising:

(a) at least one treatment unit, said treatment unit being configured to treat the external surface of the building;

(b) at least one suspension system for suspending said at least one treatment unit adjacent to the external surface, (c) at least one suction unit associated with said treatment unit, said suction unit being activated to generate suction at a suction port;

(d) a plurality of suction heads in fluid connection with said suction port and deployed to clamp against the external surface; and (e) a drive mechanism for moving said treatment unit, said drive mechanism including a belt, a plurality of suction heads are deployed in spaced relation along said belt.

14. The system of claim 13 further comprising:

(a) a fluid connection hub rotatably mounted with respect to a supply of said pressurized fluid; and (b) a plurality of tubes forming fluid connections between said fluid connection hub and each of said suction heads.

15. A method of operating a device configured for treating an external surface of a building with a pressurized fluid, the method comprising:

(a) employing the pressure of the pressurized fluid to operate a suction unit to generate suction; and (b) employing the pressure of the pressurized fluid to power a drive mechanism for moving the device relative to the external surface.

16. The method of claim 15, wherein the device is a cleaning device.

17. The method of claim 15, wherein the suction unit and the drive mechanism are operated simultaneously.

* * * * *